US009111414B1

(12) United States Patent
Sirois et al.

(10) Patent No.: US 9,111,414 B1
(45) Date of Patent: Aug. 18, 2015

(54) SPINNING GAME

(71) Applicant: Karma Gaming International Inc., Halifax (CA)

(72) Inventors: Jean-Louis Sirois, Dieppe (CA); Christopher Macleod, Moncton (CA)

(73) Assignee: KARMA GAMING INTERNATIONAL INC., Halifax, Nova Scotia (CA)

( * ) Notice: Subject to any disclaimer, the term of this patent is extended or adjusted under 35 U.S.C. 154(b) by 0 days.

(21) Appl. No.: 14/268,652

(22) Filed: May 2, 2014

(51) Int. Cl.
*G07F 17/32* (2006.01)

(52) U.S. Cl.
CPC ..... *G07F 17/323* (2013.01); *G07F 17/3209* (2013.01); *G07F 17/3211* (2013.01); *G07F 17/3213* (2013.01); *G07F 17/3297* (2013.01)

(58) Field of Classification Search
CPC ..... G07F 17/3211; G07F 17/3213
USPC ..... 463/20, 31
See application file for complete search history.

(56) References Cited

U.S. PATENT DOCUMENTS

| | | | | | |
|---|---|---|---|---|---|
| 1,892,664 | A * | 1/1933 | Eyles | 273/142 HA |
| 2,095,367 | A * | 10/1937 | Mattson | 273/142 HA |
| 2,246,383 | A * | 6/1941 | Rice | 273/142 HA |
| 2,283,583 | A * | 5/1942 | Singer | 273/142 HA |
| 2,565,557 | A * | 8/1951 | Guimond | 273/142 A |
| 3,817,532 | A * | 6/1974 | Lee | 273/142 HA |
| 3,941,389 | A * | 3/1976 | Guimond | 273/142 HA |
| 5,188,363 | A * | 2/1993 | Marnell et al. | 463/13 |
| 5,553,851 | A * | 9/1996 | Malavazos et al. | 273/142 E |
| 6,059,658 | A * | 5/2000 | Mangano et al. | 463/16 |
| 6,105,962 | A * | 8/2000 | Malavazos et al. | 273/143 R |
| 6,217,022 | B1 * | 4/2001 | Astaneha | 273/138.1 |
| 6,364,767 | B1 * | 4/2002 | Brossard et al. | 463/20 |
| 6,705,944 | B2 * | 3/2004 | Luciano | 463/20 |
| 7,354,342 | B2 * | 4/2008 | Paulsen et al. | 463/16 |
| 7,448,948 | B2 * | 11/2008 | Hughs-Baird et al. | 463/20 |
| 7,625,278 | B2 * | 12/2009 | Paulsen et al. | 463/16 |
| 7,708,628 | B2 * | 5/2010 | Baerlocher | 463/17 |
| 8,282,461 | B2 * | 10/2012 | Berman et al. | 463/16 |
| 8,636,576 | B2 * | 1/2014 | Berman et al. | 463/16 |
| 2004/0017041 | A1 * | 1/2004 | Inoue | 273/143 R |
| 2004/0162133 | A1 * | 8/2004 | Jackson | 463/20 |
| 2005/0054421 | A1 * | 3/2005 | Hughs-Baird et al. | 463/20 |

* cited by examiner

*Primary Examiner* — Steven J Hylinski
(74) *Attorney, Agent, or Firm* — Novak Druce Connolly Bove + Quigg LLP

(57) ABSTRACT

Described herein are electronic game devices that display a center region, and circular-shaped regions surrounding the center region. The circular-shaped regions, as well as the center region, contain various symbols. The circular-shaped regions spin around the center region for various amounts of time such that the entirety of each circular-shaped region is visible while the circular-shaped regions spins. When the circular-shaped regions stop spinning, if the symbols are located in pre-determined winning positions, an action occurs such as a user winning points.

21 Claims, 9 Drawing Sheets

SPINNING GAME

TECHNICAL FIELD

The present technology pertains to electronic games, and more specifically to digital wheel-reel games.

BACKGROUND

Today's electronic slot machines provide an exciting experience whether the game is played in a casino, on a computer, or on a smart-phone. Typical electronic slot machines attempt to mimic traditional, physical slot machines. In particular, electronic slot machines are typically configured to resemble traditional slot machines where wheels with various symbols spin along a plane perpendicular to a user line of sight. The symbols, located on the curved regions of the wheels, spin along with the wheels, in-and-out of sight. When the wheels stop spinning, various symbols appear in front of a user. If the symbols appear in a particular pre-defined arrangement the user wins.

Some electronic slot-type games do not spin at all. For instance, some games display a matrix filled with symbols. When a user clicks a "spin" button, the symbols randomly change into other symbols. As with electronic games that mimic the traditional wheel-reel slot machines, if the symbols appear in a particular pre-defined arrangement the user wins.

With both of these types of games, a user cannot see the symbols on the screen at all times while the wheels are spinning. For example, with wheel-reel slot games, a user cannot see symbols that are on the opposite side of the portion of the wheel visible to the user. Similarly, with other matrix games where symbols appear at random, a user cannot see in advance which symbol will appear next in a given space. Many users would like a game where they do not feel as though the electronic algorithm is "hiding" symbols. Accordingly, there is a need in the art for an electronic game where a user can view symbols that do not "disappear" when the wheels are spinning.

SUMMARY

Additional features and advantages of the disclosure will be set forth in the description which follows, and in part will be obvious from the description, or can be learned by practice of the herein disclosed principles. The features and advantages of the disclosure can be realized and obtained by means of the instruments and combinations particularly pointed out in the appended claims. These and other features of the disclosure will become more fully apparent from the following description and appended claims, or can be learned by the practice of the principles set forth herein.

Disclosed are systems, methods, devices, and non-transitory computer readable storage media for providing an interactive electronic spinning game. In particular, disclosed are spinning games where the circular-shaped regions contain symbols that do not "disappear" while the circular-shaped regions are spinning (i.e., rotating continuously).

Spinning games (also referred to as "wheel games") described herein display symbols to a user even while the wheels are spinning. In an exemplary embodiment, a game will have a center region surrounded by one or more concentric circular-shaped shaped regions. Each circular-shaped shaped region is divided into a group of sections, and each section has a symbol within it. Further, the center region has a symbol within it. At all times during game play, the symbols appear to be visible to a user.

In response to clicking a button to spin the circular-shaped regions, the circular-shaped regions spin along a plane perpendicular to the plane on which wheels in traditional slot machines spin. Namely, the circular-shaped regions described herein spin on a plane that is substantially parallel to the plane of the display screen, such that the user can view symbols on the circular-shaped regions prior to, during, and after the spin is finished.

The circular-shaped regions may begin spinning at the same time, or they may begin spinning at different times. Similarly, the circular-shaped regions may stop spinning at the same time or they may stop at different times. The circular-shaped regions may spin at different speeds. The circular-shaped regions may spin for different lengths of time. Eventually, the circular-shaped regions stop spinning. Once the circular-shaped regions stop spinning, if the symbols within the sections of the circular-shaped regions are arranged in a winning pre-defined arrangement (e.g., matching symbols are in a row), the user wins.

Of course, there may be numerous variations of the game. For example, some symbols may be a wild card. Some symbols may be a multiplier, or some other type of bonus. Some symbols may appear as a mystery symbol prior to and during the spin, and then change to a symbol once the circular-shaped regions are finished spinning.

BRIEF DESCRIPTION OF THE DRAWINGS

In order to describe the manner in which the above-recited and other advantages and features of the disclosure can be obtained, a more particular description of the principles briefly described above will be rendered by reference to specific embodiments thereof which are illustrated in the appended drawings. Understanding that these drawings depict only exemplary embodiments of the disclosure and are not therefore to be considered to be limiting of its scope, the principles herein are described and explained with additional specificity and detail through the use of the accompanying drawings in which.

DESCRIPTION

Figure 1:
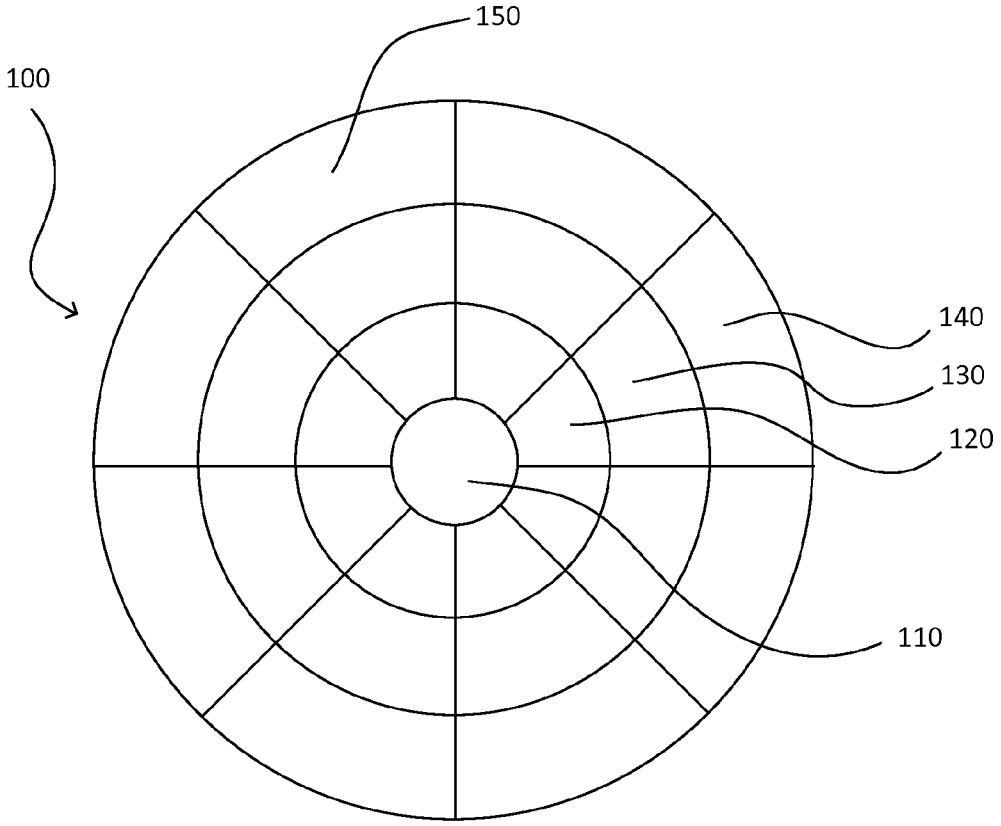
FIG. 1 illustrates an exemplary game structure with which the game is played.

Various embodiments of the disclosure are discussed in detail below. While specific implementations are discussed, it should be understood that this is done for illustration purposes only. A person skilled in the relevant art will recognize that other components and configurations can be used without parting from the spirit and scope of the disclosure.

Methods and systems described herein allow a user play an electronic game with spinning circular-shaped regions. Most traditional slot machines have a "reel strip" located on the curved surface of a wheel (or cylinder) that spins about a horizontal axis. The horizontal axis in these traditional slot machines is located on a plane substantially parallel to the display screen. In embodiments described herein, the entire reel strip is located on the flat section of circular-shaped regions, and remains in view throughout the game. In particular, the game described herein includes a center region surrounded by concentric circular-shaped regions. The circular-shaped regions include sections, and each section includes a symbol. The center region also includes a symbol. To play the game, an action occurs which causes the wheels to spin. When the circular-shaped regions are finished spinning, if the symbols in the sections of the circular-shaped regions and/or in the center region are arranged in a pre-determined winning arrangement, such as in a row, an action occurs such as winning a certain amount of points.

As used herein the term "configured" shall be considered to interchangeably be used to refer to configured and configurable, unless the term "configurable" is explicitly used to distinguish from "configured". The proper understanding of the term will be apparent to persons of ordinary skill in the art in the context in which the term is used.

As used herein, the term "user" shall be considered to mean a user of an electronic device(s). Actions performed by a user in the context of computer software shall be considered to be actions taken by a user to provide an input to the electronic device(s) to cause the electronic device to perform the steps embodied in computer software. In some embodiments, an action performed by a user may include accessing a web page.

As should be appreciated, because the game is executed on an electronic device, technically the symbols are merely pixels that appear on a display screen. However, as used herein, terms such as spinning, starting, stopping, changing, covering, modifying, disappearing, staying visible, and the like will be used to describe the appearance of the digital embodiments of the invention. For instance, although pixels are merely changing colors after a user presses a spin button, the circular-shaped regions will appear to spin. Furthermore, depending on the speed of a spinning circular-shaped region and a frame rate of a display, symbols located in circular-shaped regions may not necessarily be visible to a user's naked eye while the circular-shaped regions are spinning. However, herein symbols may be referred to as being "visible" while spinning because they do not appear to disappear from sight, such as with electronic slot machines that mimic traditional slots, or matrices where images appear and disappear in rapid succession.

FIG. 1 illustrates an exemplary game structure 100 with which the game is played. Example game structure 100 comprises a center region 110 surrounded by a first circular-shaped region 120, which in turn is surrounded by a second circular-shaped region 130, which in turn is surrounded by a third circular-shaped region 140. It should be appreciated that additional, or fewer, circular-shaped regions may be included in a game structure 100. For example, center region 110 may be surrounded by a single circular-shaped region or it may be surrounded by five circular-shaped regions.

Each circular-shaped region comprises at least one section 150. For example, there are eight (8) sections in each circular-shaped region of game structure 100. In some embodiments, each circular-shaped region is partitioned into sections of the same size.

Figure 2A:
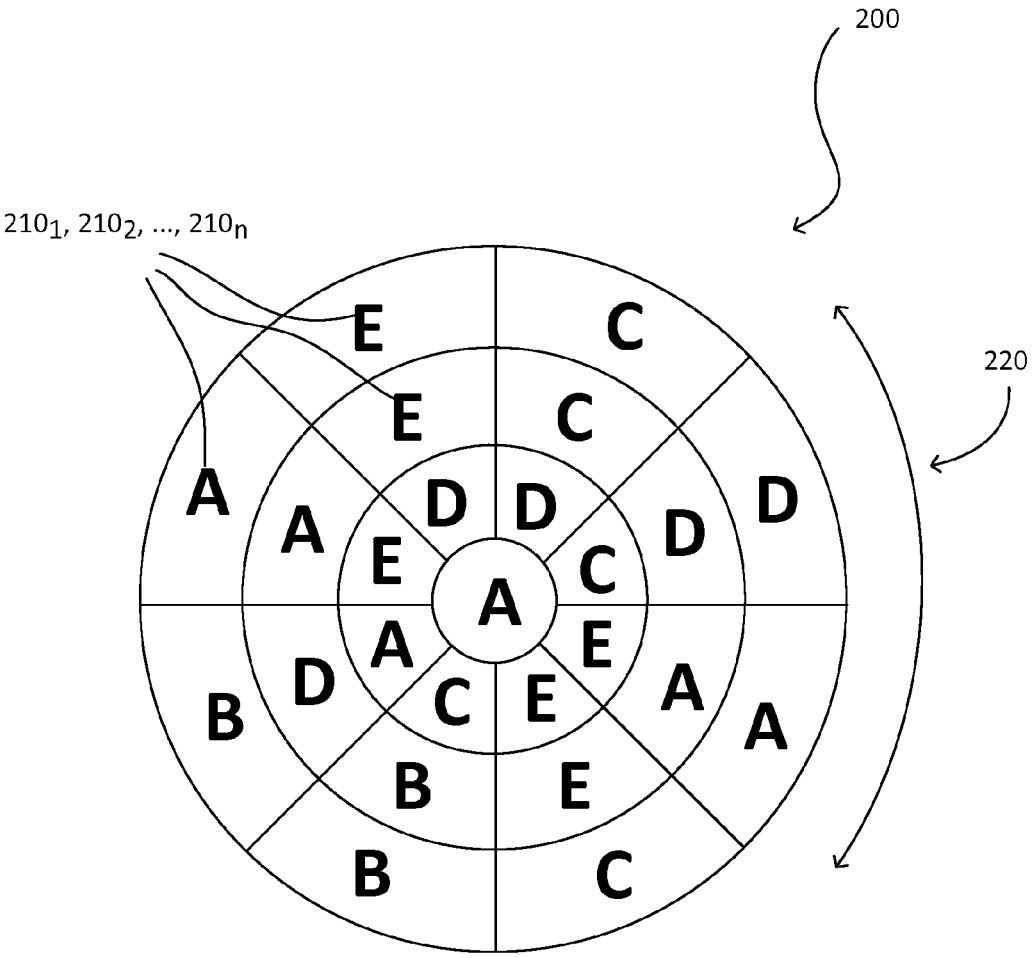
FIGS. 2A-2D illustrate exemplary methods in which the game is played.

FIG. 2A illustrates an exemplary methods in which the game is played. Here, example game structure 200 includes symbols $\mathbf{210}_1$, $\mathbf{210}_2$, . . . , $\mathbf{210}_n$(collectively "210"). In this example, game structure 200 includes twenty-five (25) example symbols 210. Each of the three (3) circular-shaped regions include eight (8) symbols 210 (one symbol in each section), and the center region 110 includes its own section that includes a symbol 210. FIG. 2A also includes spin direction indicator 220 which indicates the direction(s) in which the circular-shaped regions spin around the center region 110.

While symbols 210 are shown as letters of the English alphabet in FIGS. 2A-2D, it should be understood that the symbols may be associated with any category of symbols. For example, the symbols 210 may be different types of deserts. The letter A may be an image of a chocolate covered strawberry, the letter B may be a cupcake, the letter C may be a donut, etc. A non-exhaustive list of possible categories (or types) of symbols includes: jewels, shapes (e.g., hearts, diamonds, spades and clubs), numbers, foods, fruits, animals, dice, etc.

As indicated by spin direction indicator 220, and as discussed above, the circular-shaped regions spin around the center region 110. The circular-shaped regions are on the same plane as center region 110, and are entirely visible to a user during gameplay. There are a variety of ways in which the circular-shaped regions may spin. For example, each circular-shaped region may spin clockwise or counterclockwise. In some embodiments, all of the circular-shaped regions spin in the same direction. In some embodiments a first portion of the circular-shaped regions spin in a clockwise direction, while a second portion of the circular-shaped regions spin in a counterclockwise direction. Moreover, the circular-shaped regions may spin independent of each other, or one or more circular-shaped regions may spin based upon the spin of one or more other circular-shaped regions. In some embodiments, two or more circular-shaped regions start spinning at the same time. In some embodiments, all of the circular-shaped regions start spinning at different times. For example, the circular-shaped regions may start spinning in a staggered fashion. For instance, the outer-most circular-shaped region 140 may start spinning first and the inner-most region 120 may start spinning last. In some embodiments, two or more circular-shaped regions spin at a same speed (e.g., rotational speed or angular velocity). In some embodiments, the circular-shaped regions spin at different speeds.

Figure 2B:
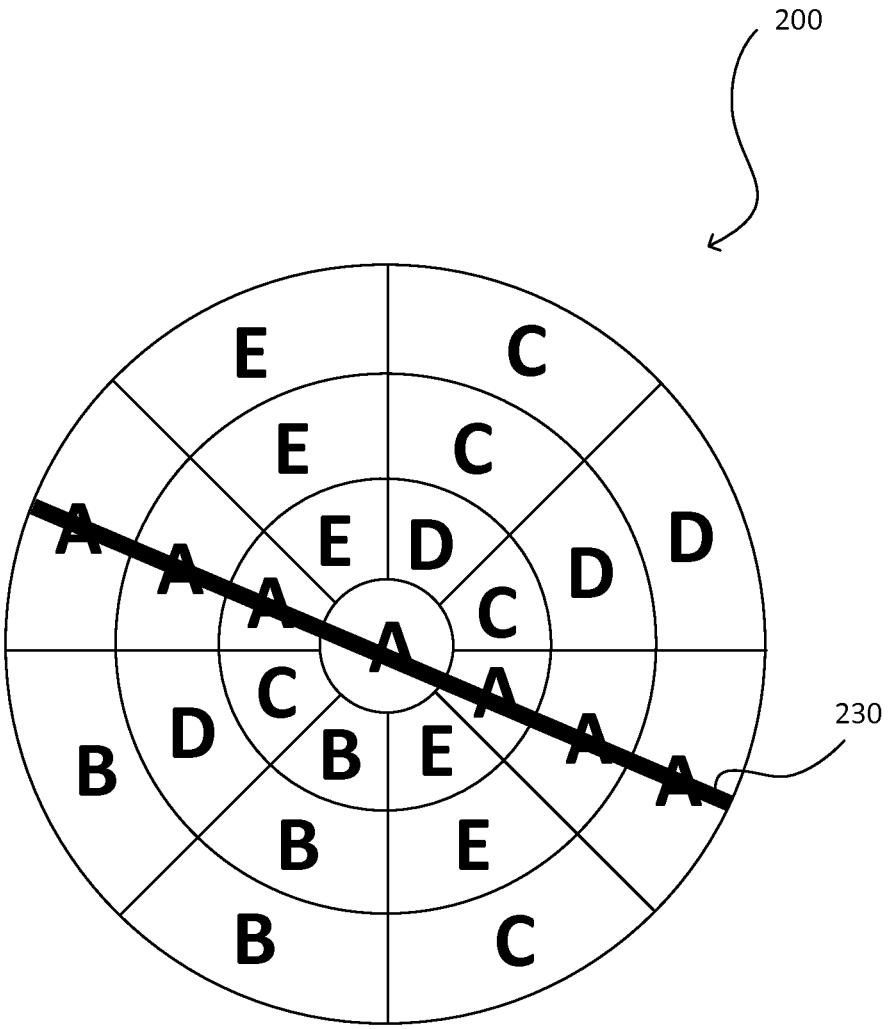

FIG. 2B also illustrates an exemplary method in which the game is played. In FIG. 2B, game structure 200 is shown after it is finished spinning. In this example, win line 230 indicates that symbols 210 are arranged in a pre-determined, winning arrangement. In particular, win line 230 indicates that seven (7) symbols of the same type are in a row (in this example, the letter "A" appears in a row of sections that spans the diameter of the circular-shaped regions). In some embodiments, when the circular-shaped regions stop spinning and the symbols 210 are in a pre-determined arrangement, different types of actions may be performed. For example, in response to seven (7) symbols of the same type being in a row, a marker in a board game may move seven spaces forward on a board. In some embodiments, in response to a winning combination of symbols occurring in a pre-determined arrangement, an alarm may sound or a notification may be sent to a user or via a network to a third party. Moreover, in some embodiments, an action may occur in response to less, or more, than seven (7) symbols being in a row after the circular-shaped regions are finished spinning. The number of symbols that must match, the number of possible win lines, or the number of symbols that must appear on a win line (i.e., in a row) may be based in part upon a wager. For instance, only a portion of the various win lines may be available based on a wager placed by a user. That is to say, in some embodiments a user may have more opportunities to win in response to a higher wager being placed.

Figure 2C:
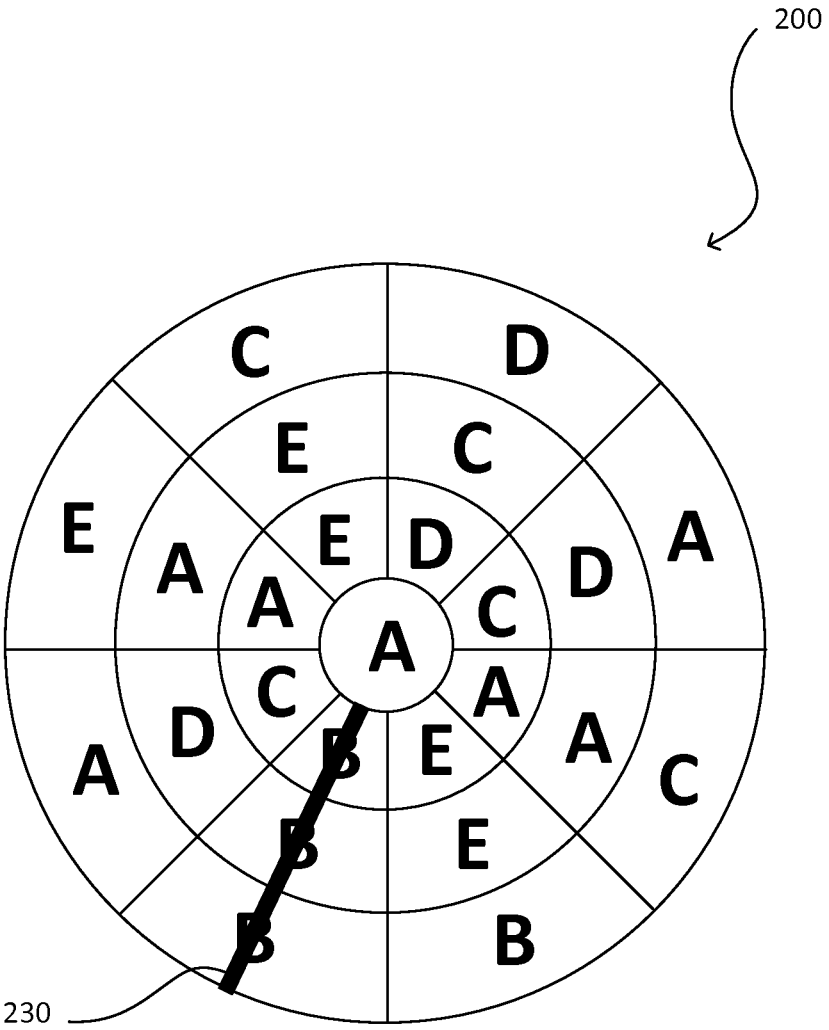

FIG. 2C also illustrates an exemplary method in which the game is played. In this example, game structure 200 again includes win line 230. However, in this example, win line 230 indicates that only three (3) symbols 210 of the same type are in a row (in this example, the letter "B"). Also, in this example, none of the winning symbols are included in the center region. Thus, it should be appreciated that a winning scenario may include any number of symbols in a row (e.g., 2, 3, 4, 5, 6, 7, etc.)

As discussed above, the game may be configured in a variety of ways to determine whether an action should occur in response to the arrangement of the symbols 210 after the circular-shaped regions are finished spinning. For example, an action may only occur if the symbol 210 in the center region is included in a row of matching symbols. In some embodiments, multiple rows of matching symbols may be required for a particular action to occur. Moreover, in embodiments where there are fewer, or more than three (3) circular-shaped regions, the number of symbols 210 required to be in a winning arrangement to cause an action to occur may be very different. It is contemplated that a very large game may contain twenty (20) or even fifty (50) concentric circular-shaped regions surrounding a center region.

Figure 2D:
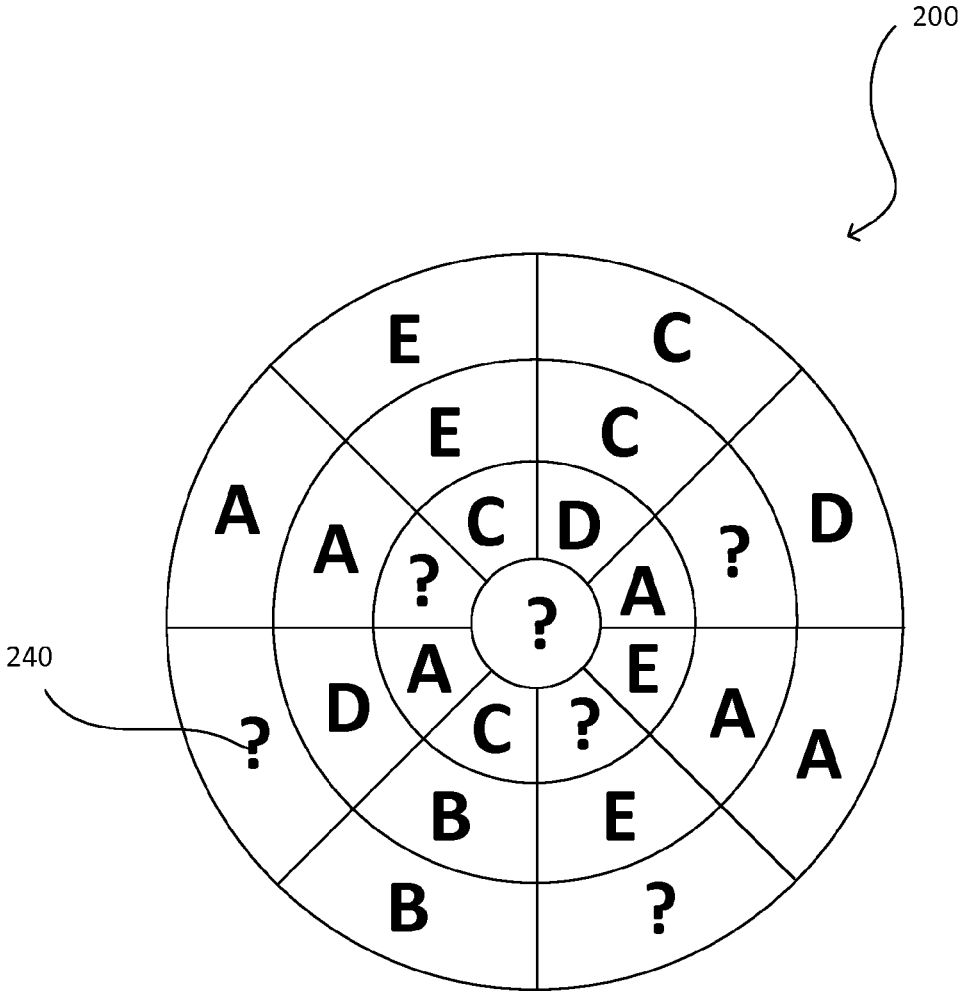

FIG. 2D illustrates another exemplary method in which the game is played. In some embodiments, special symbols are used to balance out volatility and to enhance the playing experience. In the example in FIG. 2D, a portion of the sections include mystery symbols 240. In some embodiments, mystery symbols are shown instead of the normal symbols 210 prior to spinning the circular-shaped regions. Once the circular-shaped regions are finished spinning, the mystery symbols 240 are replaced by regular symbols 210. This is sometimes referred to as a "delayed reveal". As shown in FIG. 2D, in some embodiments, the symbol located in the section in the center region is a mystery symbol 240. When there is a mystery symbol 240 in the center region, it may not be replaced by a normal symbol 210 (or "revealed") until all of the circular-shaped regions are finished spinning. In some embodiments, regardless of whether the symbol in the center region is a mystery symbol or a regular symbol, the symbol in the center region changes while the circular regions are spinning. Unlike the symbols on the circular regions, in the case where the symbol in the center region changes, the symbol in the center region disappears such that a user does not know what symbol will replace the previous symbol in the center region.

In some embodiments, bonus symbols may replace a normal symbol 210. As should be understood by those skilled in the art, bonus symbols may have a variety of properties. For example, a bonus symbol may be a "wild card," and be utilized in the same manner as any of the other symbols (e.g., a row of three symbols—comprising a cupcake, a bonus symbol, and another cupcake—would be a winning combination since the bonus symbol would be used as if it were a cupcake). In some embodiments, bonus symbols may cause more money or points to be awarded. For example, a bonus symbol may be a multiplier such that the bonus symbol may causes the points awarded to upon winning to be doubled or tripled. Moreover, there may be different types of bonus symbols that cause one or more results based at least in part on where the bonus symbols are located in the game structure 200. In some embodiments, some symbols may be placed in different sections of the various wheels, and change with every spin. Further, in some embodiments symbols adjacent to one another on the same wheel may cause a winning outcome.

Figure 3:
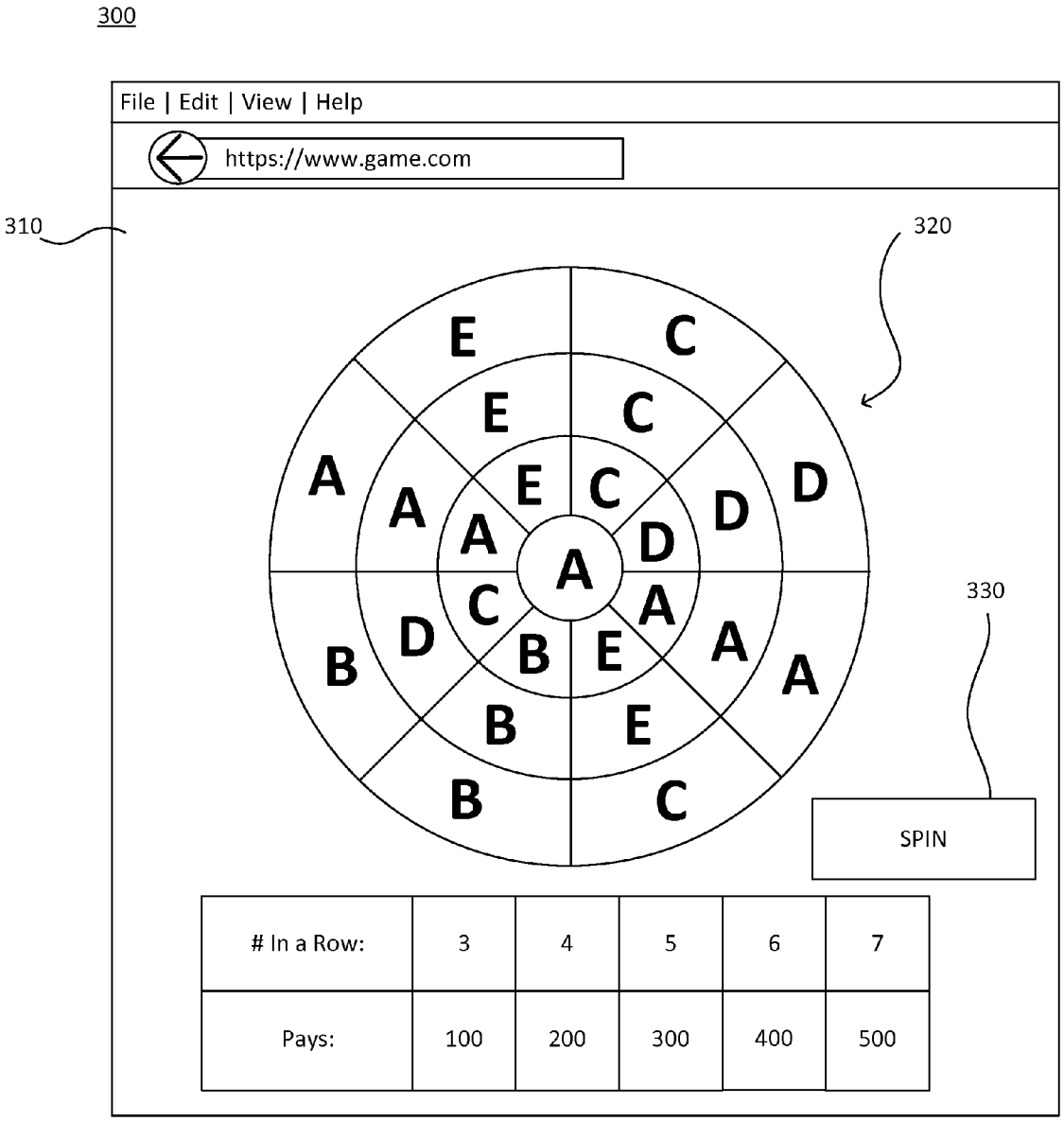
FIG. 3 illustrates an exemplary embodiment of a user interface on which a game is played.

FIG. 3 illustrates an exemplary embodiment of a user interface 300 on which a game structure 320 is displayed. In some embodiments, the user interface includes a background 310 which may include information about the game, such as how many points a user wins if the symbols 210 are in a winning arrangement when the circular-shaped regions stop spinning. In some embodiments, the user interface 300 may include a spin button 330 configured to cause the circular-shaped regions to spin. Background 310 may also include widgets which allow a user to wager a particular amount of money or points. In some embodiments, a wager must be placed in order to initiate game play. A background 310 may also show a user's balance, how many remaining spins a user has, buttons for help, auto-spin, sound effects, and to exit the game.

User interface 300 may be included in any electronic device with a display screen. For example, it may be included on an electronic gaming machine used to wager money, a computer, a smart phone, a laptop, a wearable computer, etc. In some embodiments, the user interface 300 may be displayed on a touch screen. In some embodiments, a cursor may be used to manipulate the different elements of the game, such as by clicking the spin button 330.

The display screen may be coupled with a controller, which defines the rules and requirements to produce various outcomes. These rules may include wager criteria as well as symbol combinations and payouts. The controller may determine when a circular region is spun and the length of time it spins. The controller may also determine when each wheel stops spinning, in some embodiments to produce a pre-determined outcome.

Figure 4:
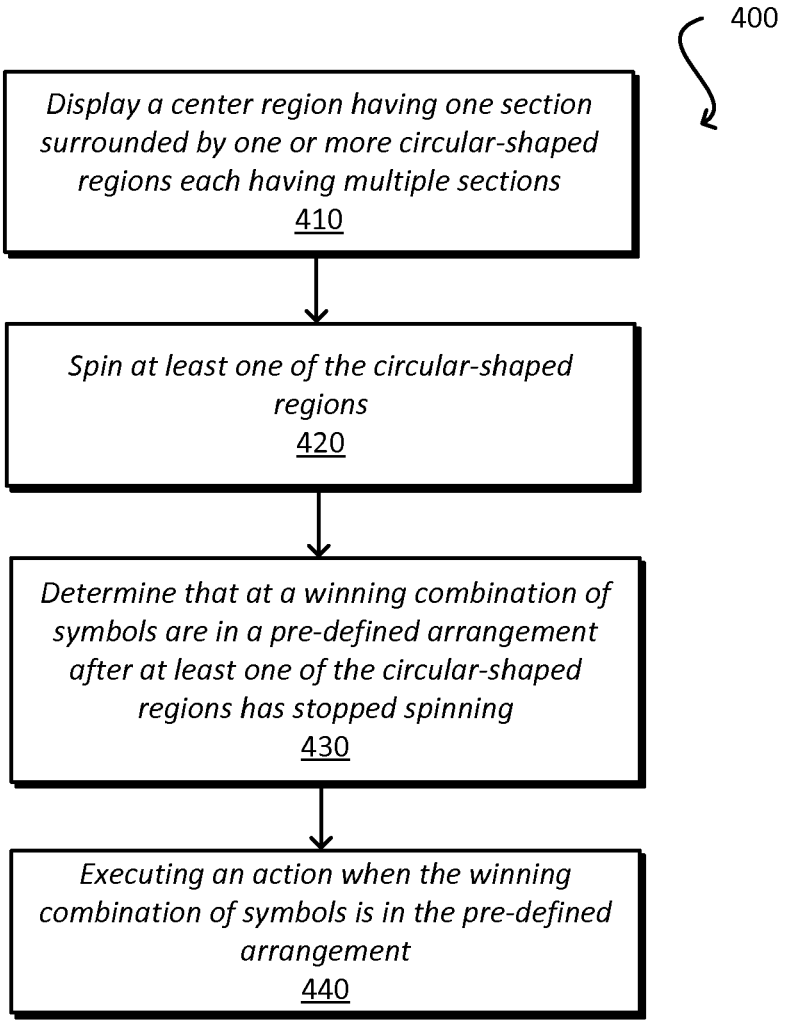
FIG. 4 illustrates an exemplary method embodiment of how the game is played.

FIG. 4 illustrates an exemplary method embodiment of how the game is played. It should be understood that example method embodiments are shown for example only. Additional or fewer steps may be added or removed from the method embodiments shown herein. In addition, at least portions of the described method diagram shown in FIG. 4 may be in a different order, in parallel, or not performed at all.

As shown, the method 400 begins at block 410, where a center region is displayed having one section surrounded by one or more circular-shaped regions each having a plurality of sections. As discussed above, the center region and the one or more circular-shaped regions appear to be located on the same plane. Further, the center region and the one or more circular-shaped regions (i.e., the game structure) appear to be located on a plane substantially parallel to a display screen. Of course, various display screens may be convex, concave, or curved in some way. In such a case, the center region and circular-shaped regions still appear substantially flat against the display screen. In any case circular regions spin about an invisible axis that enters/exits the display screen through the center region, as opposed to an axis that appears to be horizontal on the display screen and perpendicular to a user's line of sight such, as the axis in traditional electronic slot machines that mimic traditional physical slot machines (e.g., where reel strips are on the curved surfaces of thin cylindrical wheels).

At block 420 of method 400 at least one of the circular-shaped regions spins. In some embodiments, the circular regions spin at different speeds, start and stop spinning at different points in time, and/or have different spins with different durations. In some embodiments, each circular-shaped region begins spinning at a different interval of time. For example, the inner-most circular-shaped region may start spinning at a first time, the second inner-most circular-shaped region may start spinning at a second time, and so on until the outer-most circular shaped region starts spinning. At block 430 of method 400, it is determined that a winning combination of symbols are in a pre-defined arrangement after at least one of the circular-shaped regions has stopped spinning. For example, a particular combination of symbols (e.g., the same symbol) may appear in a row.

At block 440 of method 400, when the winning combination of symbols is in a predefined arrangement an action is executed. For example, a user may win a particular amount of money or points based on an amount wagered and the particular winning combination. As discussed above, a predefined arrangement may include one or more rows of symbols located in sections of the circular-shaped regions and/or the center region.

Figure 5A:
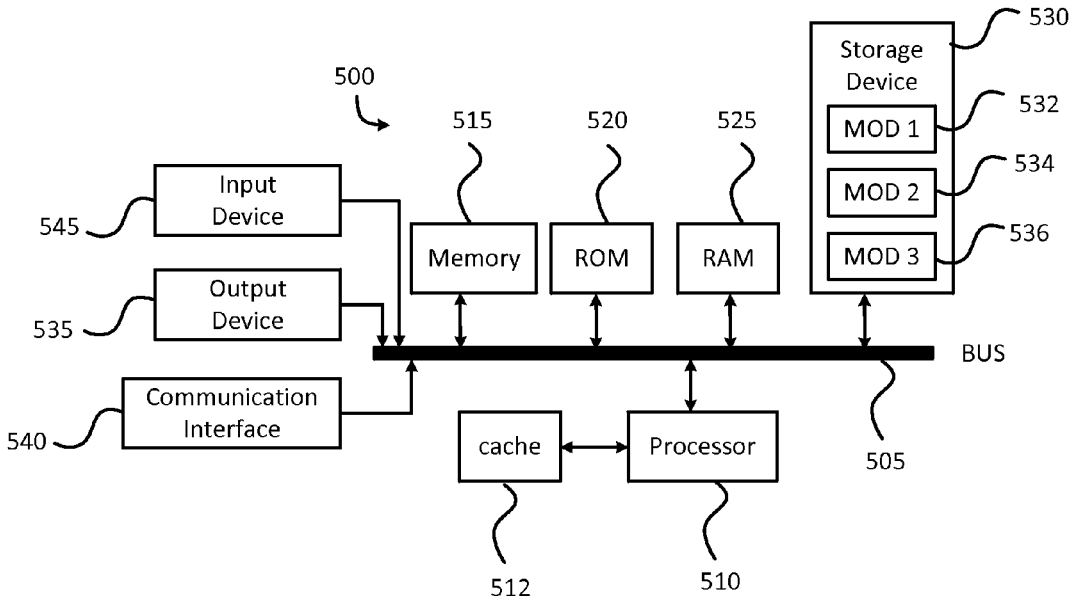
FIGS. 5A-5B illustrate exemplary electronic environments, in accordance with various embodiments.
Figure 5B:
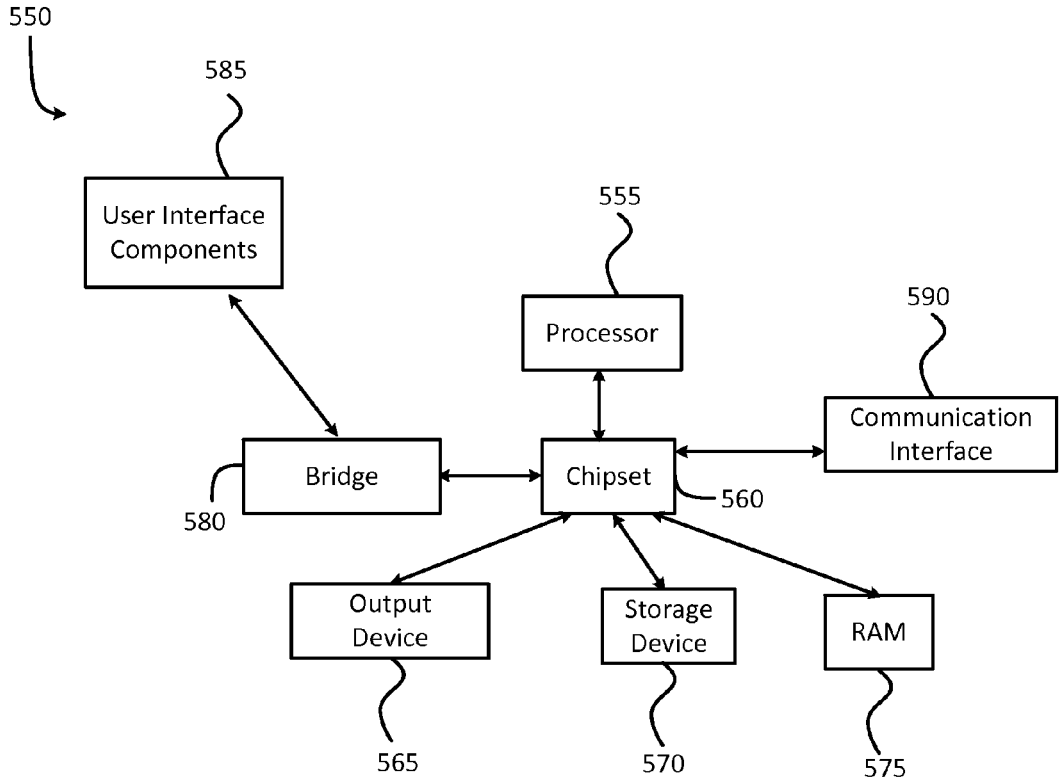

FIG. 5A, and FIG. 5B illustrate exemplary possible system embodiments. The more appropriate embodiment will be apparent to those of ordinary skill in the art when practicing the present technology. Persons of ordinary skill in the art will also readily appreciate that other system embodiments are possible.

FIG. 5A illustrates a conventional system bus computing system architecture 500 wherein the components of the system are in electrical communication with each other using a bus 505. Exemplary system 500 includes a processing unit (CPU or processor) 510 and a system bus 505 that couples various system components including the system memory 515, such as read only memory (ROM) 520 and random access memory (RAM) 525, to the processor 510. The system 500 can include a cache of high-speed memory connected directly with, in close proximity to, or integrated as part of the processor 510. The system 500 can copy data from the memory 515 and/or the storage device 530 to the cache 512 for quick access by the processor 510. In this way, the cache can provide a performance boost that avoids processor 510 delays while waiting for data. These and other modules can control or be configured to control the processor 510 to perform various actions. Other system memory 515 may be available for use as well. The memory 515 can include multiple different types of memory with different performance characteristics. The processor 510 can include any general purpose processor and a hardware module or software module, such as module 1 532, module 2 534, and module 3 536 stored in storage device 530, configured to control the processor 510 as well as a special-purpose processor where software instructions are incorporated into the actual processor design. The processor 510 may essentially be a completely self-contained computing system, containing multiple cores or processors, a bus, memory controller, cache, etc. A multicore processor may be symmetric or asymmetric.

To enable user interaction with the computing device 500, an input device 545 can represent any number of input mechanisms, such as a microphone for speech, a touch-sensitive screen for gesture or graphical input, keyboard, mouse, motion input, speech and so forth. An output device 535 can also be one or more of a number of output mechanisms known to those of skill in the art. In some instances, multimodal systems can enable a user to provide multiple types of input to communicate with the computing device 500. The communications interface 540 can generally govern and manage the user input and system output. There is no restriction on operating on any particular hardware arrangement and therefore the basic features here may easily be substituted for improved hardware or firmware arrangements as they are developed.

Storage device 530 is a non-volatile memory and can be a hard disk or other types of computer readable media which can store data that are accessible by a computer, such as magnetic cassettes, flash memory cards, solid state memory devices, digital versatile disks, cartridges, random access memories (RAMs) 525, read only memory (ROM) 520, and hybrids thereof.

The storage device 530 can include software modules 532, 534, 536 for controlling the processor 510. Other hardware or software modules are contemplated. The storage device 530 can be connected to the system bus 505. In one aspect, a hardware module that performs a particular function can include the software component stored in a computer-readable medium in connection with the necessary hardware components, such as the processor 510, bus 505, display 535, and so forth, to carry out the function.

FIG. 5B illustrates a computer system 550 having a chipset architecture that can be used in executing the described method and generating and displaying a graphical user interface (GUI). Computer system 550 is an example of computer hardware, software, and firmware that can be used to implement the disclosed technology. System 550 can include a processor 555, representative of any number of physically and/or logically distinct resources capable of executing software, firmware, and hardware configured to perform identified computations. Processor 555 can communicate with a chipset 560 that can control input to and output from processor 555. In this example, chipset 560 outputs information to output 565, such as a display, and can read and write information to storage device 570, which can include magnetic media, and solid state media, for example. Chipset 560 can also read data from and write data to RAM 575. A bridge 580 for interfacing with a variety of user interface components 585 can be provided for interfacing with chipset 560. Such user interface components 585 can include a keyboard, a microphone, touch detection and processing circuitry, a pointing device, such as a mouse, and so on. In general, inputs to system 550 can come from any of a variety of sources, machine generated and/or human generated.

Chipset 560 can also interface with one or more communication interfaces 590 that can have different physical interfaces. Such communication interfaces can include interfaces for wired and wireless local area networks, for broadband wireless networks, as well as personal area networks. Some applications of the methods for generating, displaying, and using the GUI disclosed herein can include receiving ordered datasets over the physical interface or be generated by the machine itself by processor 555 analyzing data stored in storage 570 or 575. Further, the machine can receive inputs from a user via user interface components 585 and execute appropriate functions, such as browsing functions by interpreting these inputs using processor 555.

It can be appreciated that exemplary systems 500 and 550 can have more than one processor 510 or be part of a group or cluster of computing devices networked together to provide greater processing capability.

For clarity of explanation, in some instances the present technology may be presented as including individual functional blocks including functional blocks comprising devices, device components, steps or routines in a method embodied in software, or combinations of hardware and software.

In some embodiments the computer-readable storage devices, mediums, and memories can include a cable or wireless signal containing a bit stream and the like. However, when mentioned, non-transitory computer-readable storage media expressly exclude media such as energy, carrier signals, electromagnetic waves, and signals per se.

Methods according to the above-described examples can be implemented using computer-executable instructions that are stored or otherwise available from computer readable media. Such instructions can comprise, for example, instructions and data which cause or otherwise configure a general purpose computer, special purpose computer, or special purpose processing device to perform a certain function or group of functions. Portions of computer resources used can be accessible over a network. The computer executable instructions may be, for example, binaries, intermediate format instructions such as assembly language, firmware, or source code. Examples of computer-readable media that may be used to store instructions, information used, and/or information created during methods according to described examples include magnetic or optical disks, flash memory, USB devices provided with non-volatile memory, networked storage devices, and so on.

Devices implementing methods according to these disclosures can comprise hardware, firmware and/or software, and can take any of a variety of form factors. Typical examples of such form factors include electronic gaming machines, laptops, smart phones, small form factor personal computers, personal digital assistants, and so on. Functionality described herein also can be embodied in peripherals or add-in cards. Such functionality can also be implemented on a circuit board among different chips or different processes executing in a single device, by way of further example.

The instructions, media for conveying such instructions, computing resources for executing them, and other structures for supporting such computing resources are means for providing the functions described in these disclosures.

Although a variety of examples and other information was used to explain aspects within the scope of the appended claims, no limitation of the claims should be implied based on particular features or arrangements in such examples, as one of ordinary skill would be able to use these examples to derive a wide variety of implementations. Further and although some subject matter may have been described in language specific to examples of structural features and/or method steps, it is to be understood that the subject matter defined in the appended claims is not necessarily limited to these described features or acts. For example, such functionality can be distributed differently or performed in components other than those identified herein. Rather, the described features and steps are disclosed as examples of components of systems and methods within the scope of the appended claims.

What is claimed is:

1. A non-transitory computer-readable medium having stored therein instructions that, when executed by a computer, cause one or more processors on the computing system to perform a method, comprising:

displaying, on a display, a graphical user interface comprising a game structure that includes a center region having one section surrounded by a first circular-shaped region having a first group of sections of a first size, wherein each section consists of one symbol of a set of symbols;

receiving data indicative of a wager being placed by a user via an input device or via the graphical user interface;

receiving a user input via an input device or via the graphical user interface that causes the first circular-shaped region to begin rotating at a first time;

causing the first circular-shaped region to stop rotating at a second time;

determining that a winning combination of a set of winning combinations of symbols displayed in the game structure are in a pre-defined arrangement after the first circular-shaped region stops rotating; and executing an action configured to inform the user when the winning combination of symbols are in the pre-defined arrangement.

2. The non-transitory computer-readable medium of claim 1, wherein the center region and the first circular-shaped region are on a plane substantially parallel to a display screen.

3. The non-transitory computer-readable medium of claim 1, wherein one of the symbols in the winning combination is included in the section in the center region.

4. The non-transitory computer-readable medium of claim 1, wherein a second circular-shaped region surrounds the first circular-shaped region and a third circular-shaped region surrounds the second circular-shaped region, wherein the second circular-shaped region includes a second group of sections of a second size, and wherein the third circular-shaped region includes a third group of sections of a third size.

5. The non-transitory computer-readable medium of claim 4, further comprising:

causing the second circular-shaped region to begin rotating at a third time;

causing the third circular-shaped region to begin rotating at a fourth time;

causing the second circular-shaped region to stop rotating at a fifth time; and causing the third circular-shaped region to stop rotating at a sixth time.

6. The non-transitory computer-readable medium of claim 5, wherein the first time, the third time, and the fourth time occur before the second time, the fifth time, and the sixth time.

7. The non-transitory computer-readable medium of claim 6, wherein the first circular-shaped region, the second circular-shaped region and the third circular-shaped region rotate at different respective speeds.

8. The non-transitory computer-readable medium of claim 1, wherein each section remains visible when rotating.

9. A computer-implemented method, comprising:

displaying, on a display under control of a computing device, a graphical user interface comprising a game structure that includes a center region having one section surrounded by one or more circular-shaped regions each having a plurality of sections, wherein each section consists of a symbol of a set of symbols;

receiving data indicative of a wager being placed by a user via an input device or via the graphical user interface;

receiving a user input via an input device or via the graphical user interface that triggers spinning at least one of the circular-shaped regions;

determining, by the computing device, that a winning combination of symbols of a set of winning combinations of symbols displayed in the game structure are in pre-defined arrangement after the at least one of the circular-shaped regions has stopped spinning; and executing, by the computing device, an action configured to inform the user when the winning combination of symbols is in the pre-defined arrangement.

10. The computer-implemented method of claim 9, wherein the center region and the one or more circular-shaped regions are on a plane substantially parallel to a display screen.

11. The computer-implemented method of claim 9, wherein one of the symbols in the winning combination is included in the center region.

12. The computer-implemented method of claim 9, wherein spinning the at least one of the circular-shaped regions comprises spinning at least three circular-shaped regions.

13. The computer-implemented method of claim 12, further comprising:

causing the at least three circular-shaped regions to begin spinning at different times.

14. The computer-implemented method of claim 12, further comprising:

causing the at least three circular-shaped regions to spin at different speeds.

15. The computer-implemented method of claim 14, further comprising:

causing the at least three circular-shaped regions to spin for different lengths of time.

16. The computer-implemented method of claim 9, wherein the symbols remain visible to a user while spinning.

17. A computing system comprising:

one or more processors;

a display; and a memory device including instructions that, when executed by the one or more processors, cause the computing system to:

display a graphical user interface comprising a game structure that includes a center region having one section surrounded by one or more circular-shaped regions, each including a plurality of sections, wherein each section of the plurality of sections consists of a symbol;

receiving data indicative of a wager being placed by a user via an input device or via the graphical user interface;

receiving a user input via an input device or via the graphical interface that causes the one or more circular-shaped regions to rotate;

determine that a winning combination of the symbols are in a pre-defined arrangement in the game structure after the one or more circular-shaped regions have stopped rotating; and execute an action configured to inform the user when the winning combination of symbols is in the pre-defined arrangement.

18. The computing system of claim 17, wherein the display is on a first plane, wherein the center region and the one or more circular-shaped regions are on a second plane, and wherein the first plane and the second plane are substantially parallel.

19. The computing system of claim 17, wherein one of the symbols in the winning combination is the symbol included in the section included in the center region.

20. The computing system of claim 17, wherein the one or more circular-shaped regions comprises two or more circular-shaped regions, and wherein the processors further cause the computing system to:

rotate a first circular-shaped region of the two or more circular-shaped regions at a first speed; and rotate a second circular-shaped region of the two or more circular-shaped regions at a second speed.

21. The computing system of claim 17, wherein the one or more circular-shaped regions comprises two or more circular-shaped regions, and wherein the processors further cause the computing system to:

rotate a first circular-shaped region of the two or more circular-shaped regions for a first amount of time; and rotate a second circular-shaped region of the two or more circular-shaped regions for a second amount of time.

* * * * *